United States Patent [19]

Cihal

[11] Patent Number: 4,963,056

[45] Date of Patent: Oct. 16, 1990

[54] EXPANSION JOINT AND METHOD OF MANUFACTURE

[75] Inventor: Jaroslav Čihal, Hranice na Morave, Czechoslovakia

[73] Assignee: Okresní správa silnic Přerov, Přerov, Czechoslovakia

[21] Appl. No.: 256,438

[22] Filed: Oct. 12, 1988

[51] Int. Cl.[5] ..... E01C 11/02; E01C 11/04

[52] U.S. Cl. ..... 404/69; 404/68; 404/67; 14/16.5; 52/403

[58] Field of Search ..... 404/47, 49, 64, 66, 404/67, 68, 69, 74; 14/16.5; 52/396, 403, 573

[56] References Cited

U.S. PATENT DOCUMENTS 4,063,839 12/1977 Brown ..... 404/69
4,601,604 7/1986 Clark et al. ..... 404/66 X
4,784,516 11/1988 Cox ..... 404/68 X

FOREIGN PATENT DOCUMENTS 0608844 8/1979 Switzerland ..... 14/16.5

*Primary Examiner*—William P. Neuder
*Attorney, Agent, or Firm*—Ostrolenk, Faber, Gerb & Soffen

[57] ABSTRACT

A bridge expansion joint is provided comprising an pair of blocks interconnected by a flexible sealing profile. Each block is formed by at least three vertically stacked layers made from plastic concrete compound. The two lower layers of plastic concrete are anchored to the bridge structure through an impregnation base coating. The impregnation coating is applied along the two edges of a expansion gap onto the roughened bridge structure. After fixing the size of the expansion gap, the two first layers are cast of a thickness corresponding to the height of the neighboring leveling courses of the roadway structure. The second layers are then cast to be a thickness corresponding to the total height of a protective covering placed on a waterproof insulation applied to the leveling courses and parts of the first layers, and the bearing course of the roadway structure. A continuous wearing course of the roadway structure is laid on the bearing course and the second layers, with a portion thereof being removed from the surfaces of the second layer. The expansion gap is then covered with a flexible sealing profile, and the surfaces of the second layer are coated with an adhesive film. The two third layers are then cast so as to be separated by the gap, and are of such thickness to be level with the height of the running surface of the roadway structure wearing course. A flexible sealing material is then used to fill the gap.

23 Claims, 2 Drawing Sheets

EXPANSION JOINT AND METHOD OF MANUFACTURE

FIELD OF THE INVENTION

The present invention relates to an expansion or dilatation joint for a bridge as well as to the method of manufacture of such a dilatation joint. Generally speaking, as explained hereinbelow, the bridge dilatation joint of the present invention comprises a pair of blocks interconnected with one another by a flexible sealing profile.

BACKGROUND OF THE INVENTION

Existing bridge dilatation joints are usually formed by a pair of sections arranged along both edges or sides of a dilatation gap and covered with a flexible sealing profile.

Frequent problems associated with this construction approach include defects occurring in the anchorage of the joint to the associated bridge structure and in the anchorage of waterproof insulation to the joint itself, as well as to the iron sections, caused by road maintenance machines, often leading to breakage of anchoring elements.

Other problems include the excessive wear of a wearing course and the subsequent exposure of steel (iron) sections due to differences in dynamic impact stresses exerted on the iron sections of the dilatation joint and on the wearing course, respectively.

If an asphalt road surface is built up to the level of an existing steel dilatation joint over long periods of use, the required compaction of building material necessary to maintain this relation cannot be achieved, and the additional compaction and settling of such road surface that will naturally take place will cause exposure of the steel sections. Moreover, this factor appears to be the cause of dynamic impact stresses affecting the whole bridge structure.

A prior art steel dilatation joint construction involves the use of a flexible sealing profile fixed by bolts. This solution causes problems if the flexible sealing profile has to be replaced, because the bolts are usually subjected to the effects of a corrosive environment (e.g., the corrosive effects of salt and the like).

A general disadvantage of all of the existing dilatation joint constructions involves the labor intensive and costly replacement procedures required because the whole joint structure has to be removed, including the areas of anchorage.

SUMMARY OF THE INVENTION

In accordance with the invention, the disadvantages and problems discussed above are overcome through the provision, according to the present invention, of a dilatation joint formed by a the pair of blocks interconnected with a flexible sealing profile, wherein each block comprises at least three vertically stacked layers made from plastic concrete compound (PCC).

Preferably, anchoring of at least two lower layers to a bridge structure is provided through an impregnation base coating.

The method of manufacture of a bridge dilatation joint according to the present invention includes applying an impregnation base coating on the roughened surface of the bridge structure along both edges of a dilatation gap. The first pair of bridge dilatation joint layer segments are cast onto the coating after the width of the gap has been fixed. The plastic concrete layer is poured so as to just reach the level of leveling roadway structure courses. A waterproof insulation is then provided both on the leveling courses and on the part of the first PCC layer. The second layer segments of the dilatation joint are then cast using PCC. The level of these segments is subsequently balanced by laying protective coverings (e.g., mastic asphalt) followed by the bearing courses of the roadway structure. The PCC layer of the joint must be covered by a separator before the continuous wearing course of roadway structure is laid. The latter must be removed together with the separator and thereafter the flexible sealing profile of the joint is installed to cover the dilatation gap. The surface of each second PCC layer segment is then coated with an adhesive, onto which the pair of the third layer segments are cast side-by-side. These segments are of a thickness such as to reach, i.e., extend to, the level of the wearing course of roadway structure. The rest of the dilatation gap is then filled by pouring a flexible sealing compounds.

An important advantage of the present invention involves the greatly improved anchorage of the dilatation joint to the finished and impregnated bridge structure, thereby avoiding problems caused by using insufficient concrete or by concrete shrinkage during setting. An additional benefit of the present invention results from the fact that insulation bonding to the dilatation joint is provided by means of material which produces excellent adhesion to the material of the joint. At the same time, this solution limits differences in dynamic impact stresses occurring at the interface of the steel and insulation. Further, corrosion is thus reduced or prevented because the joint is protected from water penetration.

According to an important feature of the present invention, the use of iron sections is eliminated, thereby allowing greatly improved compaction of individual roadway structure courses to be achieved even in close vicinity to dilatation joint layers.

Another advantage which follows from this feature of the invention concerns the capability of providing bridge floor reinforcement by laying additional wearing courses concurrently with the addition of the other dilatation joint layers up to the same level. Moreover, the use of dilatation "carpets" is also possible to cover and seal the dilatation gap.

Other features and advantages of the invention will be described in, or apparent from, the following detailed description of preferred embodiments of the invention.

DESCRIPTION OF THE PREFERRED EMBODIMENTS

A bridge dilatation joint should extend the full width of roadway including, in some applications, a pavement.

Figure 1:
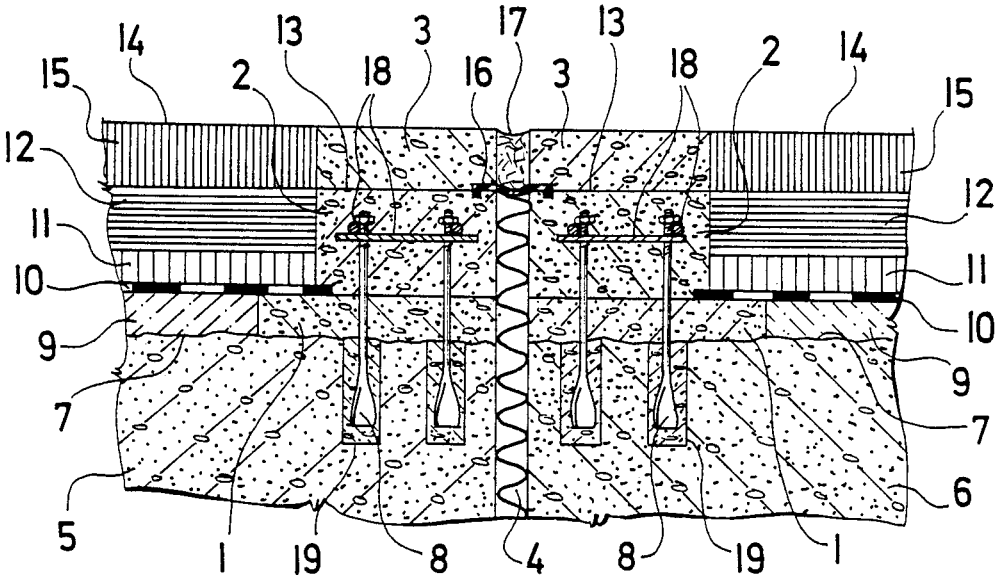
FIG. 1 is a transverse cross-section of a bridge dilatation joint.
Figure 2:
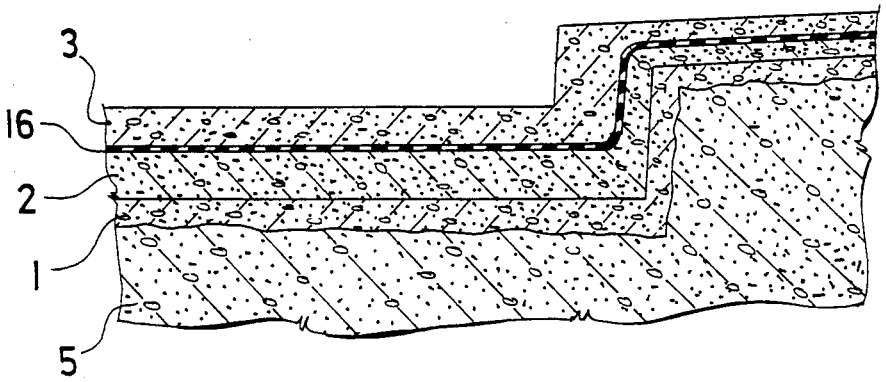
FIG. 2 is a partial longitudinal cross section of a bridge dilatation joint including a part of a roadway with an elevated pavement and a cast curbstone.

As shown in FIGS. 1 and 2, a pair of blocks, each formed from at least three layers (indicated at 1, 2, and 3), cast from plastic concrete compound, are laid along dilatation gap 4 between a bridge supporting structure 5 one side and on a bridge abutment structure 6 on the opposite side (assuming the bridge is a single-span bridge). The upper surfaces of the supporting structure 5 as well as of the bridge abutment structure 6 are provided with a base coat 7. The first layer 1 of the plastic concrete compound is cast on this impregnation base coat 7. Anchoring bolts 8 are fixed in the supporting structure 5 and in the bridge abutment 6. The anchoring bolts 8 can be replaced with a reinforcement (not shown) extending out of the supporting structure 5 and out of the bridge abutment 6.

A leveling course 9 of roadway structure (made, e.g., from a mastic asphalt or concrete) is laid alongside the first layer 1 and at the same level. The second PCC layer 2 is laid, with a lateral offset, onto the first layer 1. The upper parts of anchoring bolts 8 are embedded in this second PCC layer 2, a coating of waterproof insulation 10 is applied on the offset part of the first layer 1 and on the leveling course 9. A protective covering 11 is then formed, e.g., from mastic asphalt. On the covering 11 there is disposed a bearing course 12 of roadway structure extending up to the level of the second layer 2.

On the second layer 2, an adhesive coating 13 is applied the adhesive coating is a PCC-binder, e.g., an epoxy resin. The third layer 3 is then laid on the coating 13. The third layer 3 has a thickness necessary to reach the level of the running surface 14 of the road structure wearing course 15. Between the second layer 2 and the third layer 3, the dilatation gap 4 is covered with a flexible sealing profile 16 (made from rubber). The rest of the gap 4 (over the profile 16) is filled with a flexible sealing material 17, such as polysulphite. In the embodiment of FIG. 1, the anchoring bolts 8 are interconnected by means of a longitudinal reinforcement member 18.

Referring the method of manufacture of the bridge dilatation joint of the present invention, the surfaces of the bridge supporting structure 5 and the bridge abutment 6 are first prepared by suitable chipping or other processing and holes 19 are provided therein for the anchoring bolts 8. The surfaces of bridge support structure 5 and bridge abutment 6 are then carefully cleaned and an impregnation base coating 7 is applied thereonto on both sides of the dilatation gap 4 in a band approximately 400 mm wide. The bolts 8 are then fixed in the holes 19. The bolts can be interconnected by a longitudinal reinforcement member 18 as mentioned above, e.g., by welding.

After the width of gap 4 has been fixed, by, e.g., using foamed polystyrene slabs, the first pair of layer segments 1 are cast with plastic concrete compound. The layers 1 are cast up to the level of the neighboring leveling course or contour 9 of the roadway structure. The waterproof insulation 10 is applied both on the leveling course 9 and on parts of the first layer segments 1 as indicated in FIG. 1. The protective layer 11 is then applied.

The second PCC layers 2 are subsequently cast to cover the marginal or edge parts of waterproof insulation 10, as shown. The anchoring bolts 8, as well as the longitudinal reinforcement member 18, are embedded in the second layer 2. The protective bearing courses 12 of the roadway structure are then laid over the protective layers 11 up to the level of the second layer segments 2 of the bridge dilatation joint. The second layer segments 2 must be covered with a suitable separator (not shown), such as overlying timbers, up to the thickness of the wearing course 15, at a maximum, prior to the application of the protective bearing course 12.

Continuing the process, the wearing course 15 is then applied. Because of the separator (not shown) the wearing course 15 is cut off at the edges of the second layer segments 2 of the bridge dilatation joint. Preparation of the surfaces involved and installation of the flexible sealing profile 16 are carried out after a thorough cleaning. The surfaces of the second layer 2 are then coated with the adhesive film 13 and the pair of the third layer segments 3 of the bridge dilatation joint are cast separately to be of a thickness so as to reach the level of the running surface 14 of the roadway structure wearing course 15.

Figure 3:
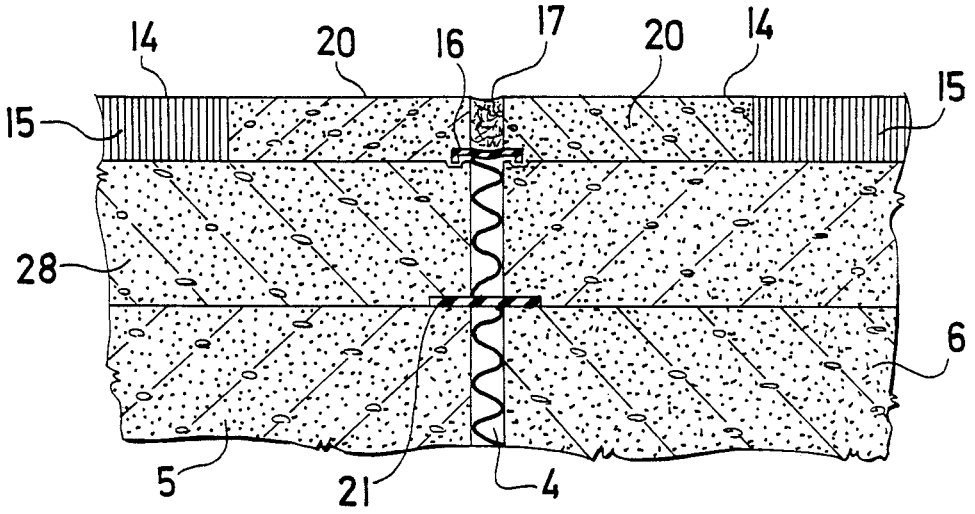
FIG. 3 is cross section of an under-surface bridge expansion or dilatation joint, in an after-repair condition.

After the third layer segments 3 have been set, the empty upper part of the dilatation gap 4 is filled by pouring the flexible sealing material 17 therein. As an alternative, a precast band of a sealing compound (not shown) can be placed on the flexible sealing profile 16 and the pair of covering PCC layers 20 cast along both sides thereof as shown in FIG. 3. In FIG. 3 the original roadway structure 28 with a damaged subsurface bridge dilatation joint 21 is shown under the wearing course 15.

The use of plastic concrete makes it possible to adjust the height of the bridge dilatation joint where there is additional thickening of roadway structure courses. In such a situation, a separator layer (e.g., of timbers) is first is placed onto the existing third layers of the bridge dilatation joint and has a thickness equal to that of the wearing course to be added, at a maximum, and then the new continuous wearing course is applied. The part of the new wearing course which covers the third layer segments 3 is then cut off along the edges of the third layer and removed. The original third layer segments 3 are then cleaned and an adhesive film applied. Onto this prepared surface, a pair of new bridge dilatation joint layers are cast up to the level of the new running surface of the roadway.

Figure 4:
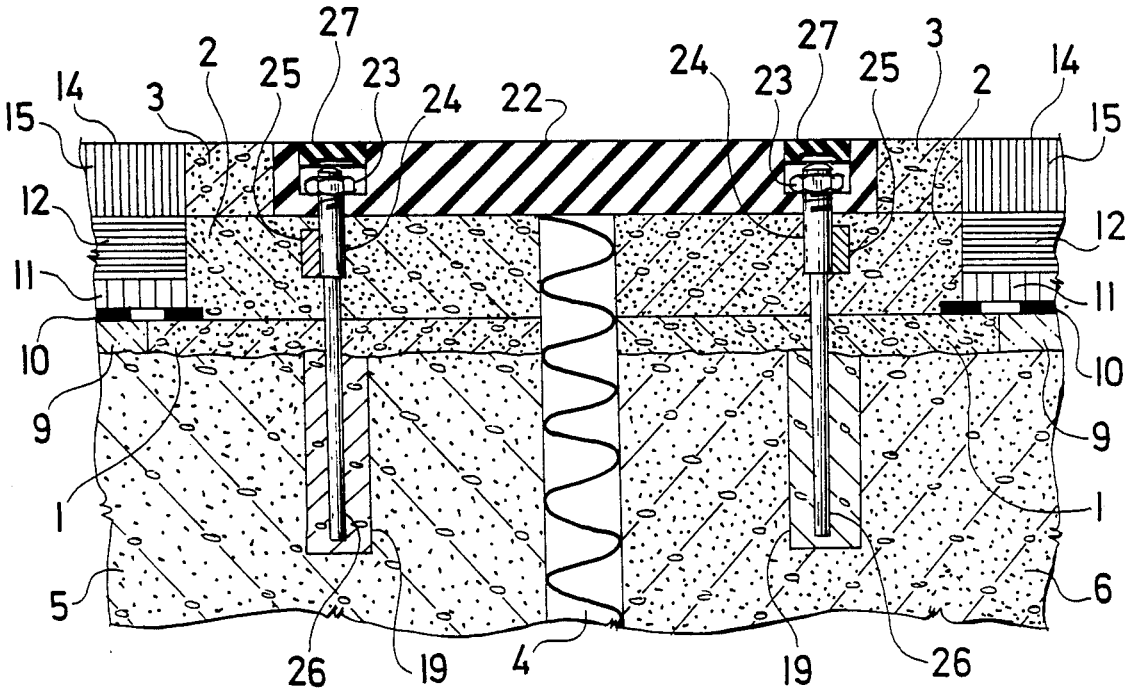
FIG. 4 is a cross section of a bridge dilatation joint with an anchored dilatation carpet.

As shown in FIG. 4, the bridge dilatation joint of the present invention can be used in combination with a dilatation carpet 22, made, e.g., from rubber, which is placed across the dilatation gap 4 and is fixed at the edges thereof by nuts 23 to bolts 24 welded onto steel sections 25 placed along the dilatation gap 4. The steel sections 25 are themselves welded to anchors 26 embedded in holes 19 bored into the supporting structure 5 of a bridge, as well as in the bridqe abutment structure 6 The nuts 23 and the heads of the connection bolts 24 are covered by closing caps or end caps 27 inserted into openings in the dilatation carpet 22.

Referring now the method of manufacture or production of the embodiment of FIG. 4, the methods of manufacture of the first layer 1 and second layer 2 of the bridge dilatation joint and of the leveling course 9, waterproof insulation 10, protective covering 11, bearing course 12 and wearing course 15 are similar to those described above in connection with the corresponding layers or components of in FIG. 1. The dilatation carpet 22 is laid down and fixed with mounting bolts 21 and nuts 23 after the wearing course 15 has been removed up to the edges of the second layer segments 2 of the bridge dilatation joint, and the facing surfaces have been cleaned and prepared. The third layers 3 of the bridge dilatation joint are cast into the gap between the dilatation carpet 22 and the wearing course 15 on the opposite sides of the carpet 22, observing the level of the running surface 14 of the roadway wearing courses 15.

The bridge dilatation joint of the present invention can be employed for building new bridges as well as for the repair of damaged subsurface bridge dilatation joints, and the like.

Thus, although the present invention has been described relative to exemplary embodiments thereof, it will be understood by those skilled in the art that variations and modifications can be effected in these exemplary embodiments without departing from the scope and spirit of the invention.

What is claimed is:

1. A method for the manufacture of the bridge expansion joint comprising a pair of blocks interconnected with a flexible sealing profile and wherein each of the blocks is formed by at least three vertically stacked layers fabricated of plastic concrete compound, said method comprising applying an impregnation coating along the two edges of an expansion gap onto a roughened bridge structure; after fixing the size of the expansion gap, casting the first layers of each block from the plastic concrete compound such that the first layers are of a thickness corresponding to the height of neighboring leveling courses of roadway structure; applying waterproof insulation to the leveling courses and to the parts of the first layers; casting the second layers of the blocks from the plastic concrete compound such that the first layers are of a thickness corresponding to the total height of a protective covering placed on the waterproof insulation and the bearing course of roadway structure; laying on the surfaces of said bearing courses and on the surfaces of said second layers, after the provision of a separator layer, a continuous wearing course of roadway structure; removing said wearing course from the surface of the second layers of the blocks together with the layer of separator, covering the dilatation gap with a flexible sealing profile and coating the surfaces of the second layers with an adhesive film; casting the third layers side-by-side so as to be separated by the gap and to be of such a thickness to equal the height of the running surface of the roadway structure wearing course; and filling the empty portion of the expansion gap between the two third layers by pouring a flexible sealing material therein.

2. A portion of a roadway, comprising:

(a) first and second roadway structures; and (b) an expansion joint for joining said roadway structures, said expansion joint comprising a first block, a second block, and a flexible sealing profile interconnecting said first and second blocks, said first block being formed of at least three vertically stacked layers, each of said layers being made from concrete, said second block being formed of at least three vertically stacked layers, each of said layers of said second block being made from concrete, the uppermost layer of said vertically stacked layers of said first block extending from said first roadway structure to said flexible sealing profile, the uppermost layer of said vertically stacked layers of said second block extending from said second roadway structure to said flexible sealing profile.

3. The roadway portion of claim 2, wherein said concrete of said first block includes plastic concrete compound, said concrete of said second block including plastic concrete compound.

4. The roadway portion of claim 3, wherein said plastic concrete compound of said first block includes an epoxy resin binder, said plastic concrete compound of said second block including an epoxy resin binder.

5. The roadway portion of claim 3, wherein said expansion joint protects against water penetration.

6. The roadway portion of claim 5, wherein said roadway structures are element of a bridge.

7. The roadway portion of claim 5, wherein a first layer of said vertically stacked layers of said first block includes a portion which is offset from a second layer of said vertically stacked layers of said first block, said second layer covering said first layer without covering said offset portion, said first roadway structure including a protective covering which covers said offset portion to anchor said first block to said first roadway structure.

8. The roadway portion of claim 7, wherein said protective covering is formed from mastic asphalt.

9. The roadway portion of claim 7, further comprising an impregnation base coat provided on said first roadway structure, said first layer being cast on said impregnation base coat.

10. The roadway portion of claim 7, wherein said first roadway structure includes a coating of waterproof insulation, said waterproof insulation covering said protective covering and said offset portion.

11. The roadway portion of claim 10, wherein said waterproof insulation has an edge which is covered by said second layer.

12. The roadway portion of claim 7, further comprising anchoring bolts and a longitudinal reinforcement member for anchoring said second layer to said first roadway structure.

13. The roadway portion of claim 7, wherein said roadway structures include wearing courses, said uppermost layers of said vertically stacked layers of said blocks having the same thickness as said wearing courses, said wearing courses and said uppermost layers defining a running surface.

14. The roadway portion of claim 5, wherein said flexible sealing profile extends between said blocks, said sealing profile having edges which are covered by said uppermost layers of said vertically stacked layers of said blocks.

15. The roadway portion of claim 14, further comprising a flexible sealing material filling a gap defined between said uppermost layers and above said sealing profile.

16. The roadway portion of claim 5, wherein said flexible sealing profile includes a carpet anchored to said roadway structures.

17. The roadway portion of claim 16, wherein said carpet is made of rubber.

18. The roadway portion of claim 5, further comprising means for fixing the width between said roadway structures and for forming a mold for casting said blocks.

19. The roadway portion of claim 18, wherein said means includes a slab of polystyrene.

20. A method of manufacturing an expansion joint between two roadway structures, comprising:

applying an impregnation base coat on rough surfaces of first and second roadway structures to be joined;

casting first layers of concrete onto said base coat;

casting second layers of concrete onto said first layers;

building up said roadway structures by applying protective layers, base layers on top of said protective layers, and wear layers on top of said base layers, said protective layers covering said first layers, said base layers being level with said second layers;

after applying said wear layers, casting third layers of concrete onto said second layers to form blocks formed of said first, second and third layers; and providing a flexible sealing profile between said blocks to form an expansion joint between said roadway structures.

21. The method of claim 20, further comprising providing waterproof insulation beneath said protective layers, said waterproof insulation covering said first layers, said second layers covering edges of said waterproof insulation.

22. The method of claim 20, further comprising removing portions of said wear layers from the surface of said second layers prior to casting said third layers.

23. The method of claim 22, further comprising applying a separator layer on said surfaces of said second layers prior to applying said wear layers.

* * * * *